US012601534B2

(12) United States Patent
Han et al.

(10) Patent No.: US 12,601,534 B2
(45) Date of Patent: Apr. 14, 2026

(54) REFRIGERATOR

(71) Applicant: SAMSUNG ELECTRONICS CO., LTD., Suwon-si (KR)

(72) Inventors: Hyoju Han, Suwon-si (KR); Ilsung Bae, Suwon-si (KR); Joohee Song, Suwon-si (KR); Byungkwan Yang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 148 days.

(21) Appl. No.: 18/076,096

(22) Filed: Dec. 6, 2022

(65) Prior Publication Data

US 2023/0098256 A1 Mar. 30, 2023

Related U.S. Application Data

(63) Continuation of application No. PCT/KR2021/002610, filed on Mar. 3, 2021.

(30) Foreign Application Priority Data

Jun. 23, 2020 (KR) ..... 10-2020-0076255

(51) Int. Cl.
*F25D 17/06* (2006.01)
*F25D 11/02* (2006.01)
*F25D 17/04* (2006.01)

(52) U.S. Cl.
CPC ..... *F25D 17/065* (2013.01); *F25D 11/02* (2013.01); *F25D 17/045* (2013.01); (Continued)

(58) Field of Classification Search
CPC ..... F25D 17/065; F25D 11/02; F25D 17/045; F25D 2317/0653; F25D 2317/0666; F25D 2323/021
See application file for complete search history.

(56) References Cited

U.S. PATENT DOCUMENTS

2004/0216476 A1 11/2004 Shin
2012/0011879 A1* 1/2012 Gu ..... F25D 17/04 62/408

(Continued)

FOREIGN PATENT DOCUMENTS

CN 109695980 A 4/2019
EP 2339275 B1 2/2017

(Continued)

OTHER PUBLICATIONS

International Search Report (PCT/ISA/210) issued Jun. 24, 2021 by the International Searching Authority in International Application No. PCT/KR2021/002610.

(Continued)

*Primary Examiner* — Elizabeth J Martin
(74) *Attorney, Agent, or Firm* — Sughrue Mion, PLLC

(57) ABSTRACT

A refrigerator includes a body including a first storage compartment and a second storage compartment; an evaporator provided in the second storage compartment and configured to supply cold air to the first storage compartment and the second storage compartment; an evaporator cover mounted to the body to cover the evaporator and including at least a first return flow path communicably connected to the first storage compartment; and an insulating partition provided between the first storage compartment and the second storage compartment and including a partition return flow path communicably connecting the first storage compartment and the first return flow path.

12 Claims, 10 Drawing Sheets

(52) U.S. Cl.
CPC ..... *F25D 2317/0653* (2013.01); *F25D 2317/0666* (2013.01); *F25D 2323/021* (2013.01)

(56) References Cited

U.S. PATENT DOCUMENTS

| | | | | |
|---|---|---|---|---|
| 2021/0285714 | A1 | 9/2021 | Heo et al. | |
| 2022/0275992 | A1 * | 9/2022 | Park | F25D 17/08 |

FOREIGN PATENT DOCUMENTS

| | | | |
|---|---|---|---|
| JP | 9-145246 | A | 6/1997 |
| JP | 2007-71496 | A | 3/2007 |
| JP | 4564994 | B2 | 10/2010 |
| JP | 5510132 | B2 | 6/2014 |
| JP | 6398073 | B2 | 10/2018 |
| JP | 2019-117036 | A | 7/2019 |
| KR | 1999-0029532 | U | 7/1999 |
| KR | 1999-0029538 | U | 7/1999 |
| KR | 10-0155970 | B1 | 10/1999 |
| KR | 10-0155971 | B1 | 10/1999 |
| KR | 10-2001-0038428 | A | 5/2001 |
| KR | 2002-0078669 | A | 10/2002 |
| KR | 2002-0078670 | A | 10/2002 |
| KR | 2003-0027367 | A | 4/2003 |
| KR | 10-2006-0041437 | A | 5/2006 |
| KR | 10-2014-0075279 | A | 6/2014 |
| KR | 10-2015-0114722 | A | 10/2015 |
| KR | 10-2018-0039871 | A | 4/2018 |
| KR | 20180039871 | A * | 4/2018 |
| KR | 10-1931940 | B1 | 12/2018 |

OTHER PUBLICATIONS

Written Opinion (PCT/ISA/237) issued Jun. 24, 2021 by the International Searching Authority om International Application No. PCT/KR2021/002610.

Communication issued Nov. 20, 2025 by the Korean Ministry of Intellectual Property in Korean Patent Application No. 10-2020-0076255.

* cited by examiner

REFRIGERATOR

CROSS-REFERENCE TO RELATED APPLICATIONS

This application is a by-pass continuation application of International Application No. PCT/KR/2021/002610, filed on Mar. 3, 2021, which based on and claims priority to Korean Patent Application No. 10-2020-0076255, filed on Jun. 23, 2020, in the Korean Intellectual Property Office, the disclosures of which are incorporated by reference herein in their entireties.

BACKGROUND

1. Field

The disclosure relates to a refrigerator, and more particularly, to a refrigerator including an evaporator configured to supply cold air to a plurality of storage compartments.

2. Description of Related Art

A refrigerator is configured to keep food fresh by including a body including a storage compartment, and a cold air supply system configured to supply cold air to the storage compartment. The storage compartment includes a refrigerating compartment maintained at approximately 0 to 5 degrees Celsius so as to keep food in a refrigerated manner, and a freezing compartment maintained at approximately 0 to minus 30 degrees Celsius to keep food in a frozen manner.

In the refrigerator, a heat insulating material is provided in the body forming the storage compartment, and a machine room is formed outside the body. Among the components constituting the cold air supply system, a compressor and a condenser are arranged in the machine room formed outside the body, an evaporator is arranged in the storage compartment formed inside the body, and a refrigerant pipe, through which refrigerants move, is arranged to penetrate the heat insulating material.

Based on the number of the evaporators being less than the number of storage compartments, the refrigerator further includes a supply duct provided to guide the cold air of the evaporator to the storage compartment and a return duct configured to return the cold air from the storage compartment to the evaporator. The supply duct and the return duct are arranged to penetrate the heat insulating material of the body.

SUMMARY

Provided is a refrigerator capable of improving a return cold air structure.

Further, provided is a refrigerator capable of reducing a material cost.

Further still, provided is a refrigerator capable of improving an insulation performance.

According to an aspect of the disclosure, a refrigerator includes: a body including a first storage compartment and a second storage compartment; an evaporator provided in the second storage compartment and configured to supply cold air to the first storage compartment and the second storage compartment; an evaporator cover mounted to the body to cover the evaporator and including at least a first return flow path communicably connected to the first storage compartment; and an insulating partition provided between the first storage compartment and the second storage compartment and including a partition return flow path communicably connecting the first storage compartment and the first return flow path.

The evaporator cover may further include a second return flow path communicably connected to the second storage compartment.

The first return flow path may be provided between the evaporator and the second storage compartment.

The evaporator cover may further include a cover supply flow path may be configured to guide the cold air into the first storage compartment and the second storage compartment, and may be provided between the evaporator and the second storage compartment, and the first return flow path may be provided on at least one of left and right sides of the cover supply flow path.

The cover supply flow path may be partitioned from the first return flow path.

The first return flow path may be provided inside the second storage compartment.

The first storage compartment may be provided above the second storage compartment, and the partition return flow path may extend in a vertical direction.

The partition return flow path may extend from a bottom surface of the first storage compartment to an upper surface of the second storage compartment.

The refrigerator may further include a storage compartment return port provided on a bottom surface of the first storage compartment and connected to the partition return flow path.

The first return flow path may extend from the partition return flow path to a lower side of the evaporator.

The insulating partition may further include a partition supply flow path configured to guide the cold air of the evaporator to the first storage compartment.

The refrigerator may further include a guide cover provided in the first storage compartment and including a guide supply flow path, and the partition supply flow path may be communicably connected to the guide supply flow path.

The evaporator cover may further include: a cover guide flow path configured to guide the cold air into the first storage compartment; and a damper configured to control an amount of the cold air flowing into the cover guide flow path.

The body may further include: an inner case; an outer case provided outside the inner case; and an insulating material provided between the inner case and the outer case, and the refrigerator may further include a supply duct penetrating the insulating material and configured to guide the cold air of the evaporator to the first storage compartment.

The evaporator cover may further include a case outlet configured to discharge the cold air of the evaporator to the second storage compartment.

The insulating partition may include expandable polystyrene (EPS).

According to an aspect of the disclosure, by placing a flow path, which is to return cold air of a first storage compartment, to an evaporator cover, a refrigerator may reduce a return path so as to reduce a flow path resistance, thereby improving an overall return cold air structure.

Further, according to an aspect of the disclosure, a refrigerator may remove a separate return cold air duct provided to return cold air of a first storage compartment, thereby reducing a material cost.

Further still, according to an aspect of the disclosure, a refrigerator may fill a space, which is occupied by a return cold air duct provided to return cold air of a first storage compartment, with an insulating material so as to improve an insulation performance.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Figure 1:
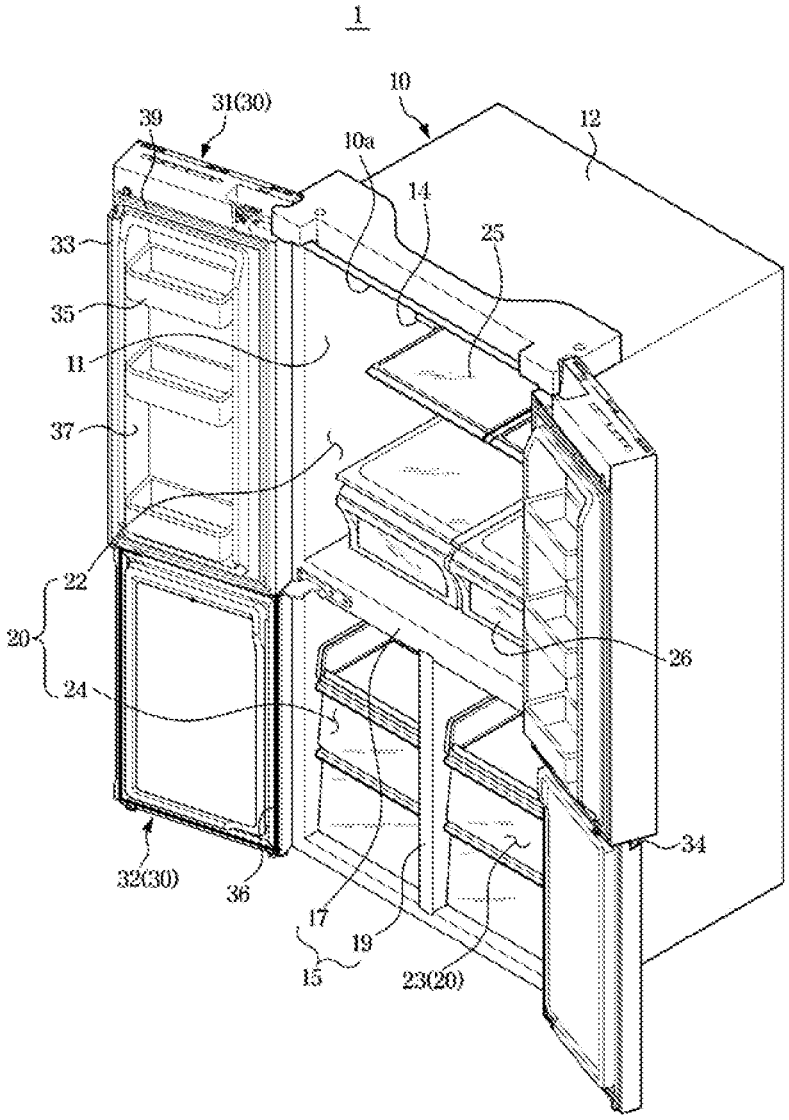
FIG. 1 illustrates a refrigerator according to an embodiment of the disclosure.

Embodiments described in this disclosure and configurations shown in the drawings are merely examples of the embodiments of the disclosure, and may be modified in various different ways at the time of filing of the present application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

In the following detailed description, the terms of "front", "upper portion", "lower portion", "left side", "right side" and the like may be defined by the drawings, but the shape and the location of the component is not limited by the term.

Hereinafter, example embodiments of the disclosure will be described in detail with reference to the accompanying drawings.

FIG. 1 is a view illustrating a refrigerator according to an embodiment of the disclosure.

Referring to FIG. 1, a refrigerator 1 includes a body 10, a storage compartment 20 vertically partitioned inside the body 10, a door 30 configured to open and close the storage compartment 20, and a cold air supply system 100 (see FIG. 2) configured to supply cold air to the storage compartment 20.

The body 10 may include an inner case 11 forming the storage compartment 20, an outer case 12 coupled to an outside of the inner case 11 to form an exterior of the refrigerator, and an insulating material 13 provided (e.g., foamed) between the inner case and the outer case to insulate the storage compartment 20.

The cold air supply system 100 may generate cold air using a refrigeration cycle of compressing, condensing, expanding, and evaporating a refrigerant. A compressor, a condenser, and an expansion valve may be arranged in a machine room 29 (refer to FIG. 4), and an evaporator 101 (refer to FIG. 4) may be arranged in the storage compartment 20.

The storage compartment 20 may be divided into a plurality compartments by a partition 15, and a plurality of shelves 25 and storage containers 26 may be provided in the storage compartment 20 to store food.

The storage compartment 20 may be divided into an upper storage compartment 22 and lower storage compartments 23 and 24) by the partition 15. The partition 15 may include a first partition 17 horizontally arranged inside the storage compartment 20 to divide the storage compartment 20 into the upper storage compartment 22 (also referred to as a first storage compartment 22) and the lower storage compartments 23 and 24 (also referred to as a second storage compartment 23 and a third storage compartment 24), and a second partition 19 vertically arranged in the lower storage compartments 23 and 24 to divide the lower storage compartments 23 and 24 into the second storage compartment 23 and the third storage compartment 24. The second partition 19 may be removably coupled to the inner case 11. A partition coupler 18 to which the second partition 19 is coupled may be formed in the inner case 11.

The partition 15 having a T-shape by combining the first partition 17 and the second partition 19 may divide the storage compartment 20 into three spaces. Among the upper storage compartment 22 and the lower storage compartments 23 and 24 defined by the first partition 17, the upper storage compartment 22 may be used as a refrigerating compartment, and the lower storage compartments 23 and 24 may be used as a freezing compartment.

All of the lower storage compartments 23 and 24 may be used as a freezing compartment. Alternatively, the second storage compartment 23 may be used as a freezing compartment and the third storage compartment 24 may be used as a refrigerating compartment. Alternatively, the second storage compartment 23 may be used as a freezing compartment and the third storage compartment 24 may be used as a freezing compartment and a refrigerating compartment.

The division of the storage compartment 20 as described above is given as an example, and the upper storage compartment 22 and the lower storage compartments 23 and 24 may be used differently from the above description.

The storage compartment 20 may be opened and closed by the door 30. The door 30 may include a pair of first doors 31 (or upper doors) configured to open and close the upper storage compartment 22, and a pair of second doors 32 (lower doors) configured to open and close the lower storage compartments 23 and 24. The pair of first doors 31 and the pair of second doors 32 may open and close an opened opening 10*a* of the body 10.

A rotating bar 33 may be provided on one of the pair of first doors 31. The rotating bar 33 may seal a gap between the pair of first doors 31 in response to the pair of first doors 31 being closed. The body 10 may be provided with a rotating bar guide 14 configured to guide a movement of the rotating bar 33.

The upper storage compartment 22 may be opened and closed by the first door 31 rotatably coupled to the body 10. The first door 31 may be opened and closed through a first door handle. The first door handle may be recessed on a lower surface of the first door 31.

A door shelf 35 provided to receive food may be provided on a rear surface of the first door 31. The door shelf 35 may include a shelf support 37 vertically extending from the first door 31 to support the door shelf 35 from left and right sides of the door shelf 35. The shelf support 37 may be provided as a separate component to be removably installed on the first door 31. According to the present embodiment, the shelf support 37 may protrude rearward from the rear surface of the first door 31 and extend in a vertical direction.

A first gasket 39 may be provided on a rear edge of the first door 31 to seal a gap between the first door 31 and the body 10 in response to the first door 31 being closed. The first gasket 39 may be installed in a loop shape along an edge on the rear surface of the first door 31, and a first magnet may be included in the first gasket 39.

The lower storage compartments 23 and 24 may be opened and closed by the second door 32 rotatably coupled to the body 10. The second door 32 may be opened and closed by a second door handle 34. The second door handle 34 may be recessed on an upper surface of the second door 32. The second door 32 may be provided in a sliding manner.

A second gasket 36 may be provided on a rear edge of the second door 32 to seal the gap between the second door 32 and the body 10 in response to the second door 32 being closed. The second gasket 36 may be installed in a loop shape along an edge on the rear surface of the second door 32, and a second magnet may be included in the second gasket 36.

Figure 2:
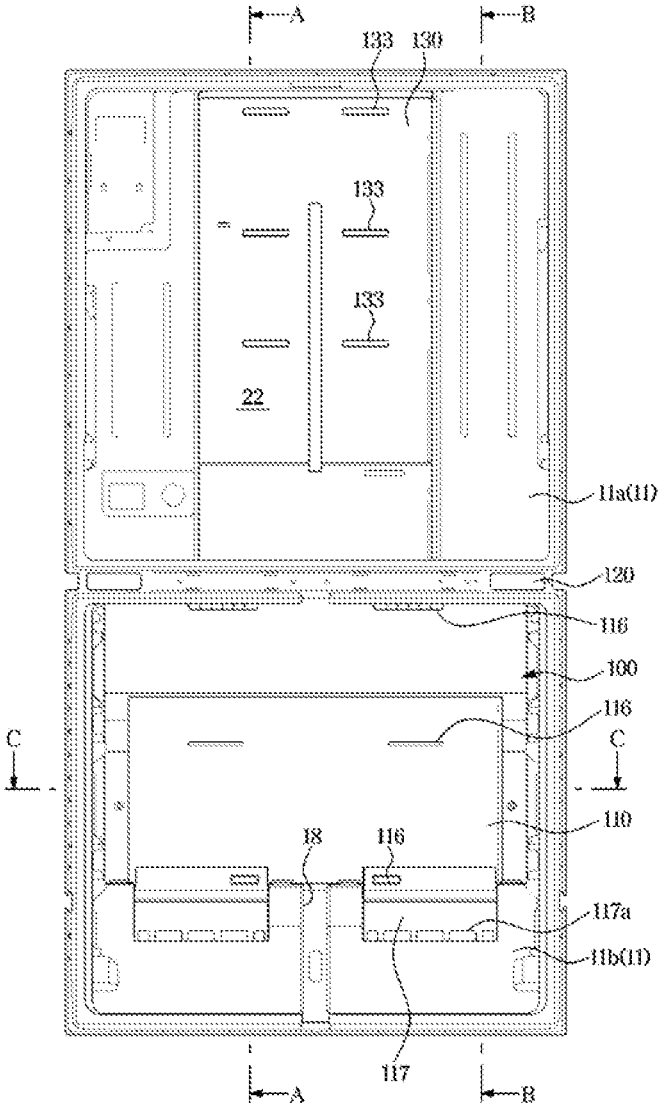
FIG. 2 illustrates a front side of an inner case shown in FIG. 1.
Figure 3:
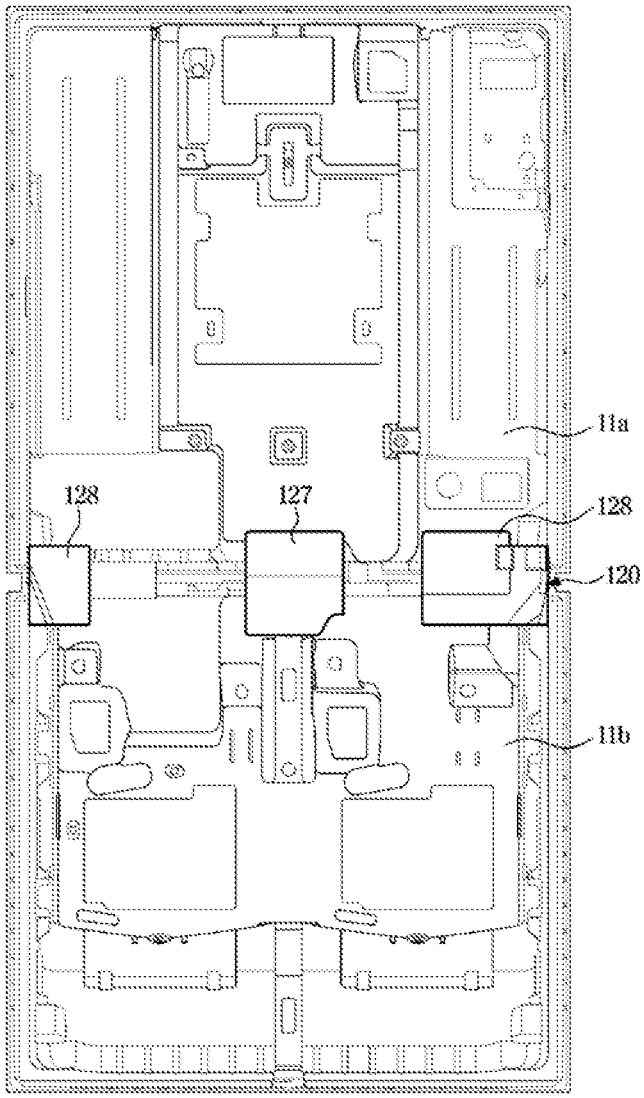
FIG. 3 illustrates a rear side of the inner case shown in FIG. 1.
Figure 4:
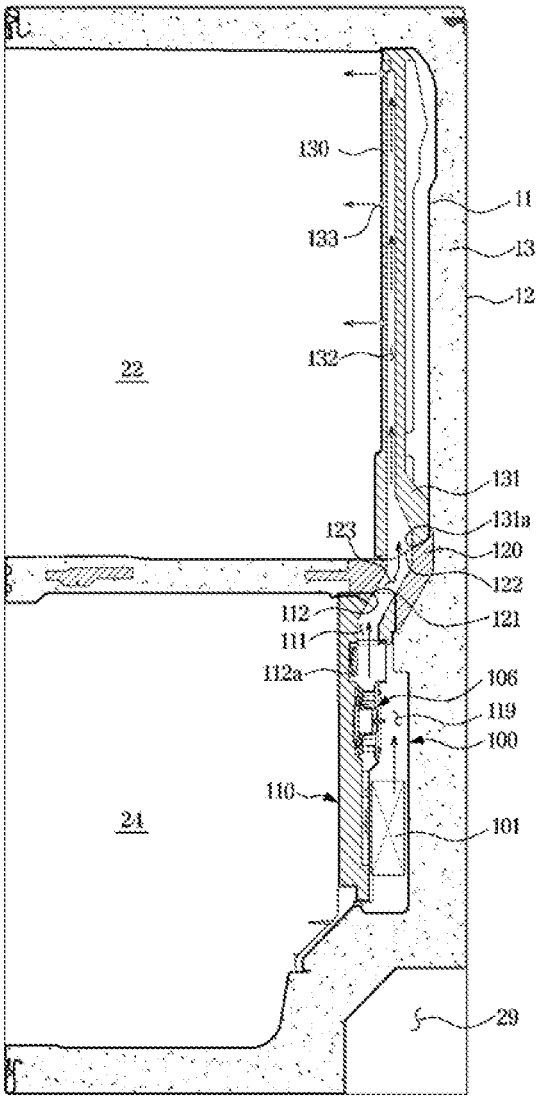
FIG. 4 is a cross-sectional view of the refrigerator taken along line A-A of FIG. 2.
Figure 5:
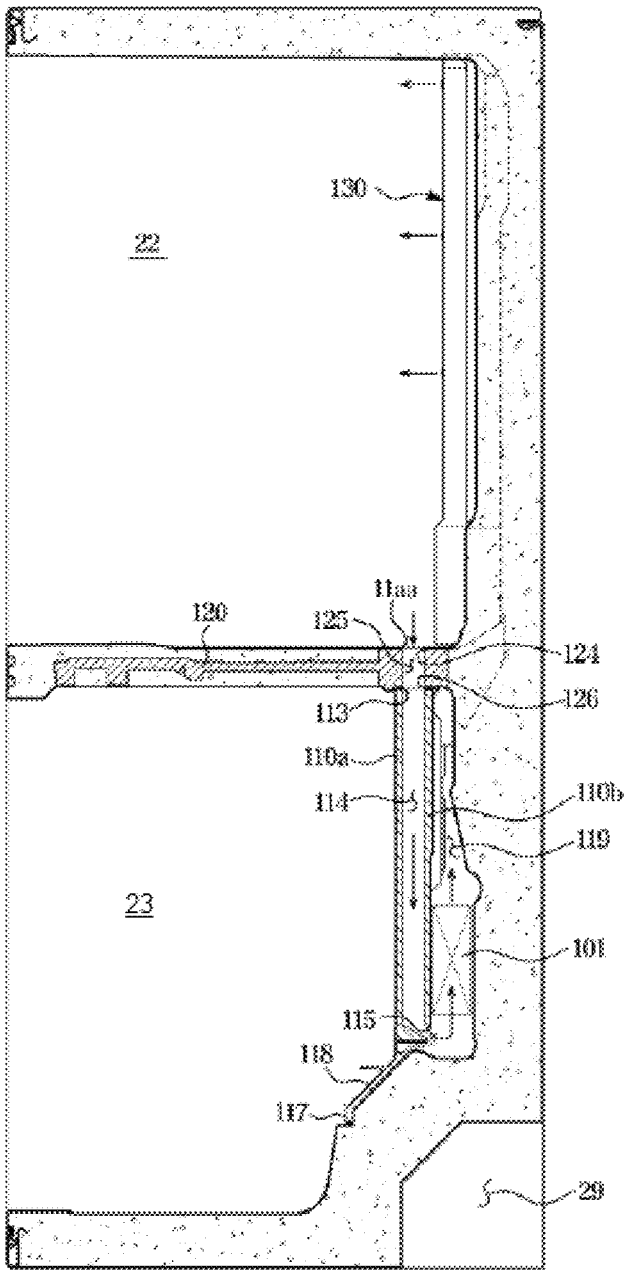
FIG. 5 is a cross-sectional view of the refrigerator taken along line B-B of FIG. 2.

FIG. 2 is a view illustrating a front side of an inner case shown in FIG. 1. FIG. 3 is a view illustrating a rear side of the inner case shown in FIG. 1. FIG. 4 is a cross-sectional view of the refrigerator taken along line A-A of FIG. 2. FIG. 5 is a cross-sectional view of the refrigerator taken along line B-B of FIG. 2.

FIGS. 2 and 3 illustrate the inner case 11 and an insulating partition 120, except for the outer case 12 and the insulating material 13, in the body 10. FIGS. 4 and 5 illustrate all of the outer case 12 and the insulating material 13 coupled to the inner case 11 and the insulating partition 120.

Referring to FIGS. 2 to 5, the inner case 11 may include an upper inner case 11*a* forming the upper storage compartment 22 and a lower inner case 11*b* forming the lower storage compartments 23, 24. The insulating partition 120 may be arranged between the upper inner case 11*a* and the lower inner case 11*b*. The insulating partition 120 may form the first partition 17.

The cold air supply system 100 may be provided in the inner case 11. The cold air supply system 100 may include an evaporator 101, a blower fan 106, an evaporator cover 110, and a guide cover 130.

The cold air supply system 100 may include the insulating partition 120. Because the insulating partition 120 defines the upper storage compartment 22 and the lower storage compartments 23 and 24, the insulating partition 120 may correspond to a component of the first partition 17. In addition, because the insulating partition 120 guides cold air of the evaporator cover 110 to the guide cover 130, the insulating partition 120 may correspond to a component of the cold air supply system 100.

The evaporator 101 may be located at a rear of the storage compartment 20. The evaporator 101 may be located in the second storage compartments 23 and 24. The evaporator 101 may be covered by the evaporator cover 110. The evaporator 101 may be configured to generate cold air.

The blower fan 106 may be arranged inside the evaporator cover 110. The blower fan 106 may be configured to move the cold air generated by the evaporator 101 to the upper storage compartment 22 and/or the lower storage compartments 23 and 24, and configured to return the cold air of the upper storage compartment 22 and/or the lower storage compartments 23 and 24 to the evaporator cover 110.

The evaporator cover 110 may be located inside the inner case 11. The evaporator cover 110 may be located on the lower inner case 11*b*. The evaporator cover 110 may be located in the second storage compartments 23 and 24.

The evaporator cover 110 may include a case 110*a* and a case cover 110*b*. The case cover 110*b* may cover a rear surface of the case 110*a*. The blower fan 106 may be arranged between the case 110*a* and the case cover 110*b*. The evaporator 101 may be positioned between the case cover 110*b* and the rear surfaces of the lower storage compartments 23 and 24.

Referring to FIG. 4, the evaporator cover 110 may include a cover guide flow path 111. The cover guide flow path 111 may guide the cold air blown by the blower fan 106 toward the upper storage compartment 22. A cover outlet 112 may be formed at an end of the cover guide flow path 111.

The evaporator cover 110 may further include a damper 112*a* configured to adjust an amount of cold air flowing into the cover guide flow path 111. The refrigerator 1 according to one embodiment of the present disclosure may adjust a temperature of the upper storage compartment 22 by controlling the damper 112*a*.

The insulating partition 120 may be arranged between the upper storage compartment 22 and the lower storage compartments 23 and 24. The insulating partition 120 may be formed of expandable polystyrene (EPS).

The insulating partition 120 may include a supply flow path forming member 127 and a return flow path forming member 128. FIGS. 3 and 4 illustrate that a single supply flow path forming member 127 and two return flow path forming members 128 are provided, but the number of the supply flow path forming members 127 and the return flow path forming members 128 are not limited thereto.

The supply flow path forming member 127 may guide the cold air of the evaporator cover 110 to the guide cover 130. A partition supply flow path 123 may be formed inside the supply flow path forming member 127. A supply flow path inlet 121 may be located at one end of the partition supply flow path 123, and a supply flow path outlet 122 may be located at the other end of the partition supply flow path 123. The partition supply flow path 123 may guide the cold air of the evaporator 101 to the upper storage compartment 22.

The partition supply flow path 123 may communicate with (be communicably connected to) a guide supply flow path 132 formed in the guide cover 130.

The supply flow path inlet 121 may be connected to the cover outlet 112. The cold air discharged from the cover outlet 112 may be introduced into the insulating partition 120 through the supply flow path inlet 121.

The guide cover 130 may be located inside the inner case 11. The guide cover 130 may be located on the upper inner case 11*a*. The guide cover 130 may be located inside the upper storage compartment 22. The guide cover 130 may guide the cold air generated by the evaporator 101 to the upper storage compartment 22. The guide cover 130 may include a guide outlet 133 discharging cold air to the upper storage compartment 22. The guide outlet 133 may be provided in plurality.

The guide cover 130 may include the guide supply flow path 132 guiding the cold air to the upper storage compartment 22. The cold air passing through the guide supply flow path 132 may be discharged to the upper storage compartment 22 through the guide outlet 133.

The guide cover 130 may include a guide inlet 131 connected to the supply flow path outlet 122 of the insulating partition 120. The cold air of the insulating partition 120 may be introduced into the guide cover 130 through the guide inlet 131. The guide inlet 131 may include a guide inlet port 131*a*.

Referring to FIG. 5, a storage compartment return port 11*aa* may be formed on a bottom surface of the upper storage compartment 22. The storage compartment return port 11 as may be formed in the upper inner case 11*a*. The storage compartment return port 11 as may be connected to the return flow path forming member 128 of the insulating partition 120.

The return flow path forming member 128 may guide the cold air of the upper storage compartment 22 to the evaporator cover 110. A partition return flow path 125 may be formed inside the return flow path forming member 128. A return flow path inlet 124 may be located at one end of the partition return flow path 125, and a return flow path outlet 126 may be located at the other end of the partition return flow path 125. The partition return flow path 125 may allow the first storage compartment 22 to communicate with (be communicably connected to) the first return flow path 114. The partition return flow path 125 may extend approximately in the vertical direction. The partition return flow path 125 may extend from the bottom surface of the first storage compartment 22 to the upper surfaces of the second storage compartments 23 and 24.

The return flow path inlet 124 may be connected to the storage compartment return port 11*aa*. The air of the upper storage compartment 22 may be introduced into the insulating partition 120 through the return flow path inlet 124.

The return flow path outlet 126 may be connected to the cover inlet 113 of the evaporator cover 110. The air of the partition return flow path 125 may be introduced into the evaporator cover 110 through the return flow path outlet 126.

Air introduced into the evaporator cover 110 may be moved to the evaporator 101 along the first return flow path 114. The first return flow path 114 may communicate with (be communicably connected to) the first storage compartment 22 through the partition return flow path 125. The first return flow path 114 may be located between the evaporator 101 and the second storage compartments 23 and 24, which may represent that the first return flow path 114 is arranged inside the second storage compartments 23 and 24.

A cover return port 115 may be formed at the other end opposite to one end of the first return flow path 114 in which the cover inlet 113 is formed. The air cooling the upper storage compartment 22 may be returned to the evaporator 101 through the cover return port 115. The cover return port 115 may be located below the evaporator 101. The first return flow path 114 may extend from the partition return flow path 125 to a lower side of the evaporator 101.

As mentioned above, as for the refrigerator 1 according to one embodiment of the present disclosure, three storage compartments (the first storage compartment 22 and the second storage compartments 23 and 24), and the single evaporator 101 may be provided, and a flow path provided to return the cold air of the upper storage compartment 22 may be formed in the insulating partition 120 and the evaporator cover 110. Accordingly, it is possible to reduce a return cold air path and thus it is possible to reduce a flow path resistance. Therefore, it is possible to improve an overall return cold air structure. Further, as for the refrigerator 1 according to one embodiment of the present disclosure, because a separate return cold air duct for returning cold air from the upper storage compartment 22 is removed, it is possible to reduce a material cost. In addition, because a space, which is occupied by the return cold air duct provided to return the cold air of the upper storage compartment 22, is filled with an insulating material, an insulation performance may be improved.

Referring to FIG. 2, a case outlet 116 may be formed in the case 110*a*. The case outlet 116 may be provided in plurality. The case outlet 116 may discharge the cold air generated by the evaporator 101 to the lower storage compartments 23 and 24. In response to the second partition 19 being coupled to the partition coupler 18, the case outlet 116 may be formed at a position that is approximately symmetrical with respect to the partition coupler 18, so as to discharge cold air to the second storage compartment 23 and the third storage compartment 24.

The evaporator cover 110 may include a return cover 117. The return cover 117 may be located at a lower end of the case 110*a*. The return cover 117 may be formed to return cold air from the lower storage compartments 23 and 24. A second return flow path 118 may be formed inside the return cover 117. The second return flow path 118 may communicate with (be communicably connected to) the second storage compartments 23 and 24. The return cover 117 may include a case return port 117*a*. The case return port 117*a* may be provided in plurality.

Figure 6:
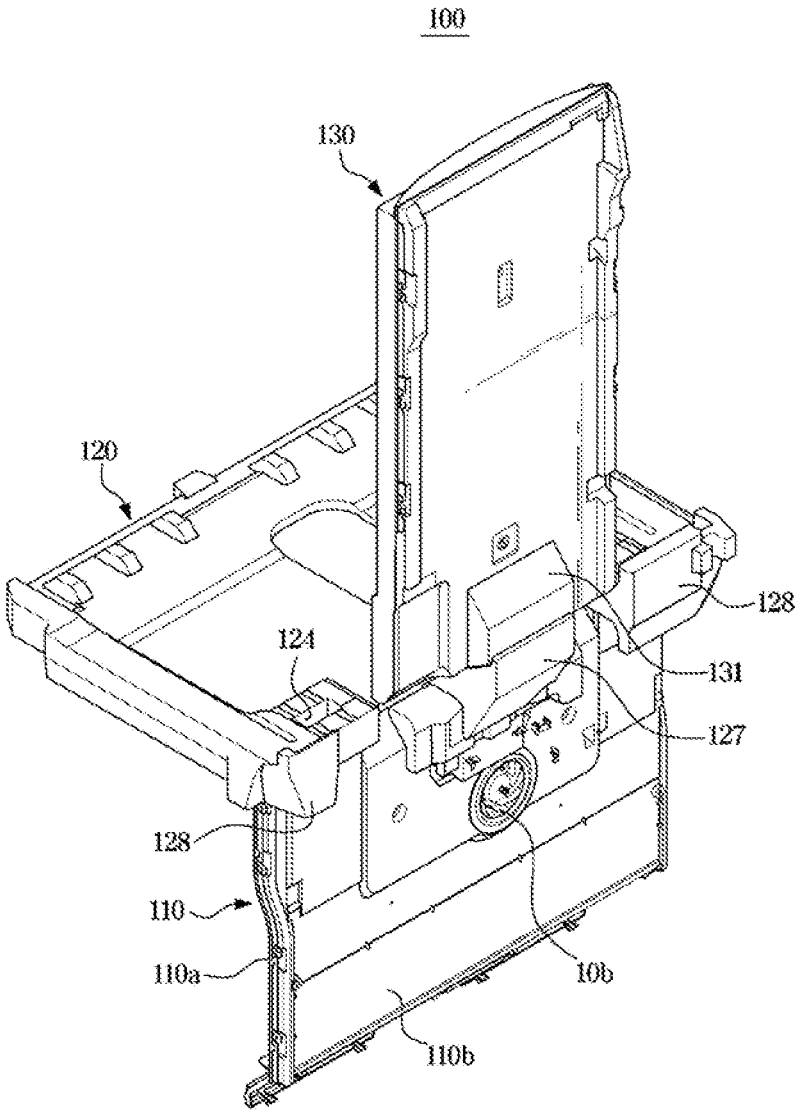
FIG. 6 is a view illustrating an evaporator cover, an insulating partition, and a guide cover shown in FIGS. 2 and 3.
Figure 7:
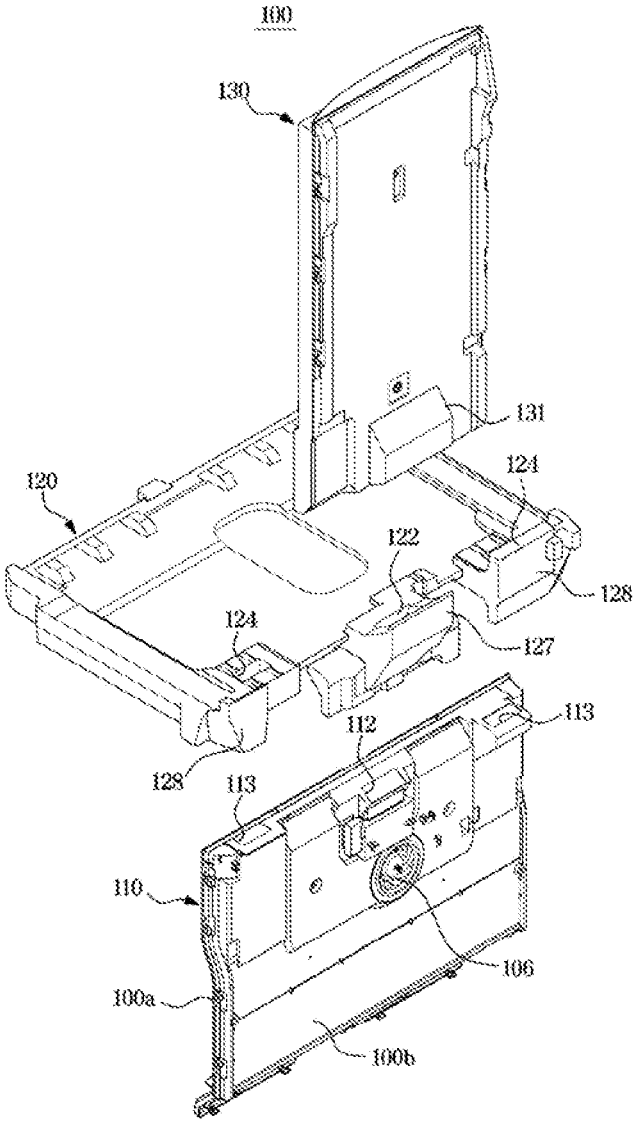
FIG. 7 is a view illustrating a state in which the evaporator cover, the insulating partition, and the guide cover shown in FIG. 6 are separated from each other.
Figure 8:
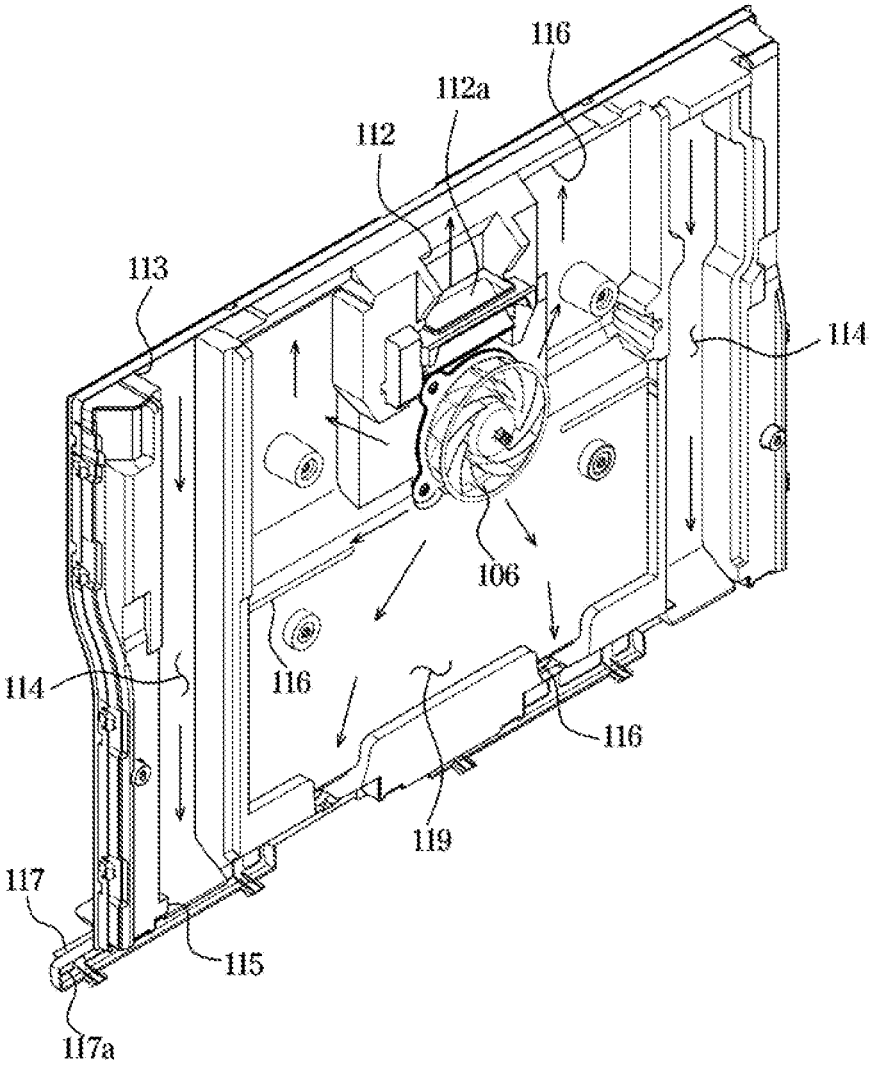
FIG. 8 is a view illustrating a state in which a case cover is separated from a case of the evaporator cover shown in FIG. 7.
Figure 9:
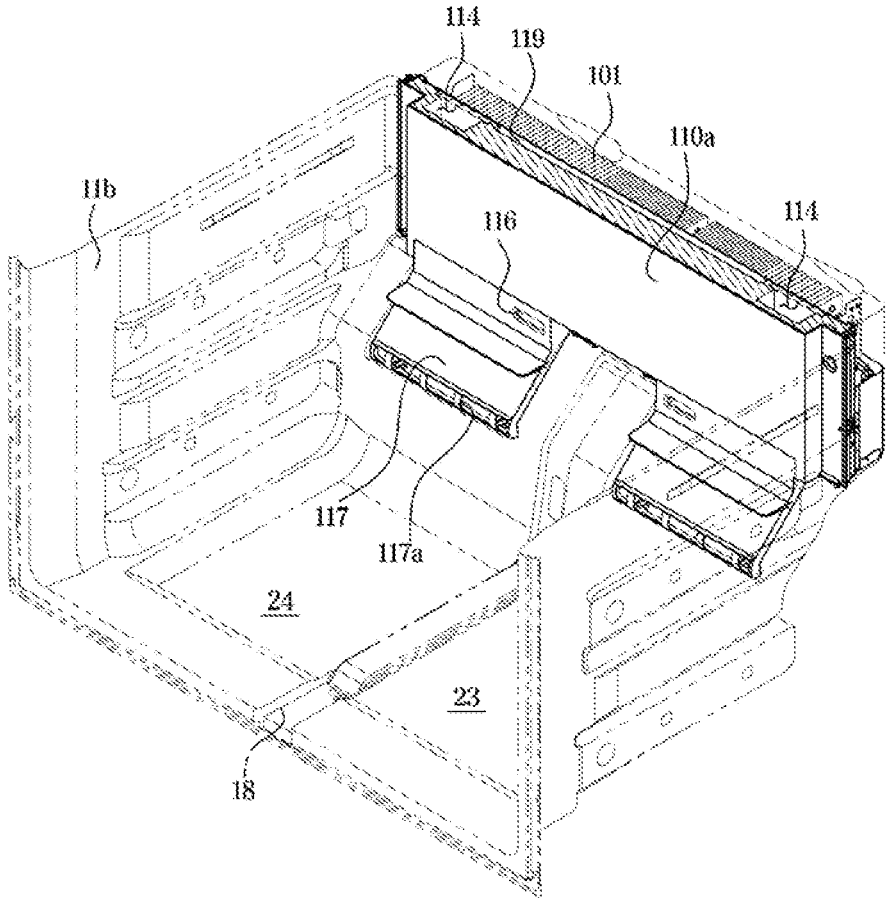
FIG. 9 is a perspective view illustrating a cross-section of the refrigerator taken along line C-C shown in FIG. 2.

FIG. 6 is a view illustrating the evaporator cover 110, the insulating partition 120, and the guide cover 130 shown in FIGS. 2 and 3. FIG. 7 is a view illustrating a state in which the evaporator cover 110, the insulating partition 120, and the guide cover 130 shown in FIG. 6 are separated from each other. FIG. 8 is a view illustrating a state in which a case cover is separated from a case of the evaporator cover shown in FIG. 7. FIG. 9 is a perspective view illustrating a cross-section of the refrigerator taken along line C-C shown in FIG. 2

The cold air supply system 100 according to one embodiment of the present disclosure will be described in more detail with reference to FIGS. 6 to 9.

Referring to FIGS. 6 and 7, the cover outlet 112 of the evaporator cover 110 may be connected to the supply flow path forming member 127 of the insulating partition 120. The supply flow path outlet 122 of the supply flow path forming member 127 may be connected to the guide inlet port 131*a* formed in the guide inlet 131 of the guide cover 130.

The return flow path inlet 124 may be formed in the return flow path forming member 128 of the insulating partition 120. The return flow path forming member 128 may be connected to the cover inlet 113.

Referring to FIGS. 8 and 9, the air introduced into the first return flow path 114 through the cover inlet 113 is moved to the evaporator 101 through the cover return port 115.

The air of the lower storage compartments 23 and 24 may be returned to the evaporator cover 110 through the case return port 117*a* of the return cover 117. The air returned to the evaporator cover 110 may be heat-exchanged with the air, which is introduced through the cover return port 115, in the evaporator 101.

A cover supply flow path 119 may be formed between the case 110*a* and the case cover 110*b*. A portion of the heat-exchanged air in the evaporator 101 may be discharged to the case outlet 116 through the cover supply flow path 119 by the blower fan 106, and then supplied to the lower storage compartments 23 and 24. Another portion of the heat-exchanged air in the evaporator 101 may pass through the cover supply flow path 119 by the blower fan 106, and flow to the cover outlet 112 to be supplied to the upper storage compartment 22.

The first return flow path 114 may be located on the left and/or right sides of the cover supply flow path 119. The first return flow path 114 may be partitioned from the cover supply flow path 119.

Figure 10:
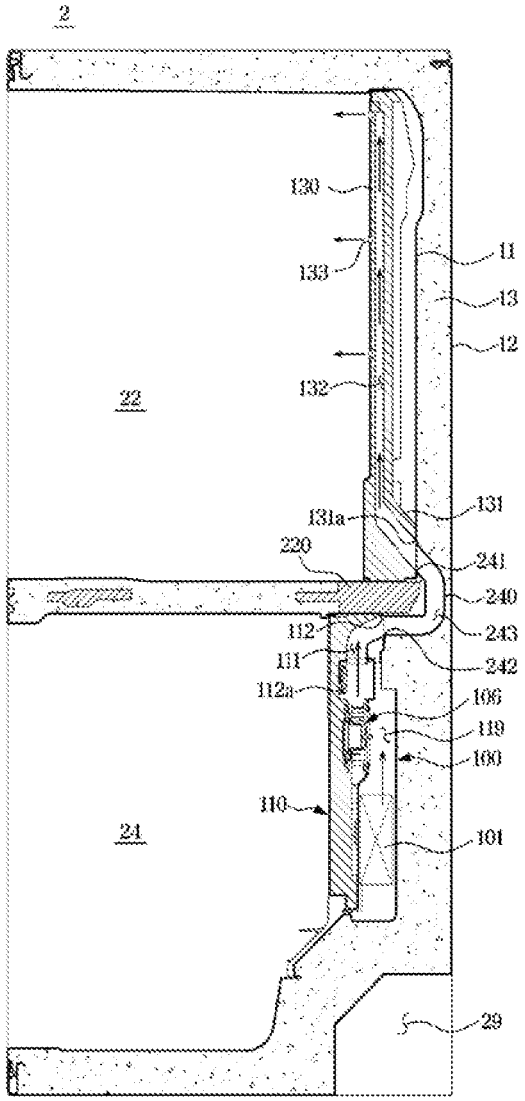
FIG. 10 is a cross-sectional view of a refrigerator according to an embodiment of the disclosure.

FIG. 10 is a cross-sectional view of a refrigerator according to another embodiment of the present disclosure.

A refrigerator 2 according to another embodiment of the present disclosure will be described with reference to FIG. 10. However, the same reference numerals may be assigned to the same components as in the embodiment shown in FIGS. 1 to 9, and detailed descriptions may be omitted.

In the refrigerator 1 shown in FIG. 4, the partition supply flow path 123 is formed in the insulating partition 120 to guide the cold air generated by the evaporator 101 to the upper storage compartment 22. However, referring to FIG. 10, the refrigerator 2 according to another embodiment of the present disclosure includes a separate supply duct 240 to guide the cold air generated by the evaporator 101 to the upper storage compartment 22.

The supply duct 240 may be arranged to penetrate the insulating material 13. An inlet 242 of the supply duct 240 may be connected to the cover outlet 112 of the evaporator cover 110, and an outlet 241 of the supply duct 240 may be connected to the guide inlet port 131*a* of the guide inlet 131. The supply duct 240 may form a connection flow path 243 connecting the evaporator cover 110 and the guide cover 130. Accordingly, an insulating partition 220 illustrated in FIG. 10 does not include a separate flow path provided to guide the cold air of the evaporator 101 to the first storage compartment.

While example embodiments of the present disclosure have been particularly described, it should be understood by those of skilled in the art that various changes in form and details may be made without departing from the spirit and scope of the present disclosure.

What is claimed is:

1. A refrigerator comprising:

a body comprising a first storage compartment and a second storage compartment;

an evaporator provided in the second storage compartment and configured to supply cold air to the first storage compartment and the second storage compartment;

an evaporator cover mounted to the body to cover the evaporator and comprising a multi-flow path control structure comprising:

a first return flow path communicably connected to the first storage compartment, a cover supply flow path configured to guide the cold air into the first storage compartment and the second storage compartment, wherein the cover supply flow path is provided between the evaporator and the second storage compartment, a cover guide flow path configured to guide the cold air into the first storage compartment, and a damper disposed within the cover guide flow path and configured to control an amount of the cold air flowing into the cover guide flow path;

an insulating partition provided between the first storage compartment and the second storage compartment and comprising:

a partition return flow path communicably connecting the first storage compartment and the first return flow path, and a partition supply flow path configured to guide the cold air of the evaporator to the first storage compartment;

a guide cover provided in the first storage compartment and comprising a guide supply flow path that is communicatively connected to the partition supply flow path, wherein the first return flow path is provided on at least one of left and right sides of the cover supply flow path, and wherein the evaporator cover surrounds around outer surfaces of the evaporator.

2. The refrigerator of claim 1, wherein the evaporator cover further comprises a second return flow path communicably connected to the second storage compartment.

3. The refrigerator of claim 1, wherein the first return flow path is provided between the evaporator and the second storage compartment.

4. The refrigerator of claim 1, wherein the cover supply flow path is partitioned from the first return flow path.

5. The refrigerator of claim 1, wherein the first return flow path is provided inside the second storage compartment.

6. The refrigerator of claim 1, wherein the first storage compartment is provided above the second storage compartment, and wherein the partition return flow path extends in a vertical direction.

7. The refrigerator of claim 6, wherein the partition return flow path extends from a bottom surface of the first storage compartment to an upper surface of the second storage compartment.

8. The refrigerator of claim 1, further comprising: a storage compartment return port provided on a bottom surface of the first storage compartment and connected to the partition return flow path.

9. The refrigerator of claim 1, wherein the first return flow path extends from the partition return flow path to a lower side of the evaporator.

10. The refrigerator of claim 1, wherein the body further comprises:

an inner case;

an outer case provided outside the inner case; and an insulating material provided between the inner case and the outer case, and wherein the refrigerator further comprises a supply duct penetrating the insulating material and configured to guide the cold air of the evaporator to the first storage compartment.

11. The refrigerator of claim 1, wherein the evaporator cover further comprises a case outlet configured to discharge the cold air of the evaporator to the second storage compartment.

12. The refrigerator of claim 1, wherein the insulating partition comprises expandable polystyrene (EPS).

* * * * *